US011512537B2

(12) United States Patent
Sullivan et al.

(10) Patent No.: US 11,512,537 B2
(45) Date of Patent: Nov. 29, 2022

(54) DISPLACEMENT MEMBERS COMPRISING MACHINEABLE MATERIAL PORTIONS, BIT BODIES COMPRISING MACHINEABLE MATERIAL PORTIONS FROM SUCH DISPLACEMENT MEMBERS, EARTH-BORING ROTARY DRILL BITS COMPRISING SUCH BIT BODIES, AND RELATED METHODS

(71) Applicant: Baker Hughes Oilfield Operations LLC, Houston, TX (US)

(72) Inventors: Eric C. Sullivan, Houston, TX (US); Kenneth R. Evans, Spring, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 16/782,902

(22) Filed: Feb. 5, 2020

(65) Prior Publication Data

US 2021/0238928 A1 Aug. 5, 2021

(51) Int. Cl.
*E21B 10/54* (2006.01)

(52) U.S. Cl.
CPC ..... *E21B 10/54* (2013.01)

(58) Field of Classification Search
CPC ..... E21B 10/43; E21B 10/62; E21B 10/627; E21B 10/633; E21B 10/46; E21B 10/56
See application file for complete search history.

(56) References Cited

U.S. PATENT DOCUMENTS 3,645,331 A * 2/1972 Maurer ..... E21B 10/61 175/65
4,720,371 A * 1/1988 Shirley ..... E21B 10/46 419/13
8,272,295 B2 9/2012 Smith et al.
9,624,730 B2 4/2017 Runquist et al.
2004/0245022 A1* 12/2004 Izaguirre ..... E21B 10/567 175/374
2010/0101868 A1 4/2010 Izaguirre et al.
2010/0314176 A1* 12/2010 Zhang ..... E21B 10/567 175/383
2018/0230755 A1 8/2018 Cook, III et al.

FOREIGN PATENT DOCUMENTS

EP 3594441 A1 1/2020

OTHER PUBLICATIONS

International Search Report for International Application No. PCT/US2021/016662, dated May 27, 2021, 3 pages.
International Written Opinion for International Application No. PCT/US2021/016662, dated May 27, 2021, 4 pages.

* cited by examiner

*Primary Examiner* — Cathleen R Hutchins
(74) *Attorney, Agent, or Firm* — TraskBritt

(57) ABSTRACT

Displacements for use in forming at least a portion of a bit body of an earth-boring rotary drill bit may comprise a machineable material portion configured to form an integral machineable material portion of the bit body. Such displacements may optionally also include a sacrificial material portion. Bit bodies resulting from the use of such displacements may comprise a main body comprised of a particle-matrix composite material and a plurality of integral machineable material portions. Earth-boring rotary drill bits may include such bit bodies. Methods of manufacturing such bit bodies, and methods of manufacturing earth-boring rotary drill bits utilizing displacements are also disclosed.

17 Claims, 7 Drawing Sheets

DISPLACEMENT MEMBERS COMPRISING MACHINEABLE MATERIAL PORTIONS, BIT BODIES COMPRISING MACHINEABLE MATERIAL PORTIONS FROM SUCH DISPLACEMENT MEMBERS, EARTH-BORING ROTARY DRILL BITS COMPRISING SUCH BIT BODIES, AND RELATED METHODS

TECHNICAL FIELD

Embodiments of the present disclosure generally relate to methods and devices for forming earth-boring rotary drill bits and components thereof. More particularly, embodiments of the present invention relate to displacements including machineable material portions that may be used to define precise geometric features on or in a bit body of an earth-boring rotary drill bit, and to methods of forming earth-boring rotary drill bits and bit bodies using such displacements.

BACKGROUND

Rotary drill bits are commonly used for drilling well bores in earth formations. One type of rotary drill bit is the fixed-cutter bit (often referred to as a "drag" bit), which typically includes a plurality of cutting elements secured to a face region of a bit body. The bit body of a rotary drill bit may be formed from steel. Alternatively, the bit body may be formed from a particle-matrix composite material. A bit body formed from a particle-matrix composite is much more resistant to wear than a bit body formed from steel. The properties of the particle-matrix composite material that make a particle-matrix bit body resistant to wear, however, also make the particle-matrix composite bit body very difficult to machine. Accordingly, it is important that the tolerances of particle-matrix bit bodies be very accurate to the desired final shape at the time the bit bodies are released from the mold and cooled, as it is very difficult to correct any defects in a particle-matrix bit body after it is hardened and released from the mold, such as by machining. Defects, such as deviations in bit body geometry relative to a designed geometry, can be detrimental to the efficiency and longevity of the resulting rotary drill bit. Achieving high levels of accuracy in particle-matrix bit body geometry has been difficult through traditional molding techniques alone, and correcting any defects after molding has also proven difficult.

BRIEF SUMMARY

In some embodiments, the present disclosure includes displacements for use in forming at least a portion of a bit body of an earth-boring rotary drill bit. Such displacements may comprise a machineable material portion configured to form an integral machineable portion of the bit body.

In additional embodiments, the present disclosure includes bit bodies that may comprise a main body comprised of a particle-matrix composite material and a plurality of integral machineable portions. The particle-matrix composite material of the main body may comprise hard particles and a binder material. The integrated machineable material portions of the bit body may be derived from the machineable material portions of displacements, and the integrated machineable material portions may be substantially free of the hard particles.

In additional embodiments, the present disclosure includes earth-boring rotary drill bits that include bit bodies that may comprise a main body comprised of a particle-matrix composite material and a plurality of integral machineable portions. The particle-matrix composite material of the main body may comprise hard particles and a binder material. The integrated machineable material portions of the bit body may be derived from the machineable material portions of displacements, and the integrated machineable material portions may be substantially free of the hard particles.

In additional embodiments, the present disclosure includes methods of manufacturing bit bodies. For such methods a plurality of displacements may be provided, wherein each displacement of the plurality of displacements comprises a machineable material portion. The plurality of displacements may be positioned into a mold. The hard particles may then be positioned into the mold. The binder material may then may be melted and the hard particles may be infiltrated with the molten binder material. The binder material may then be cooled to form the bit body such that the binder material and the hard particles combine to form a main body of the bit body comprising a particle-matrix composite material and the binder material and the machineable portion of each of the plurality of displacements form a bond therebetween to form a plurality of integral machineable portions in the bit body.

Further embodiments of the present disclosure include methods of manufacturing earth-boring rotary drill bits. For such methods a plurality of displacements may be provided, wherein each displacement of the plurality of displacements comprises a machineable material portion. The plurality of displacements may be positioned into a mold. The hard particles may then be positioned into the mold. The binder material may then may be melted and the hard particles may be infiltrated with the molten binder material. The binder material may then be cooled to form the bit body such that the binder material and the hard particles combine to form a main body of the bit body comprising a particle-matrix composite material and the binder material and the machineable portion of each of the plurality of displacements form a bond therebetween to form a plurality of integral machineable portions in the bit body. Each of the machineable portions may then be machined to define a plurality of cutting element pockets, and a cutting element may be positioned into each of the plurality of cutting element pockets.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

The illustrations presented herein are not meant to be actual views of any particular earth-boring tool, rotatable cutting element or component thereof, but are merely idealized representations employed to describe illustrative embodiments. The drawings are not necessarily to scale. Additionally, elements common between figures may retain the same numerical designation.

Figure 1:
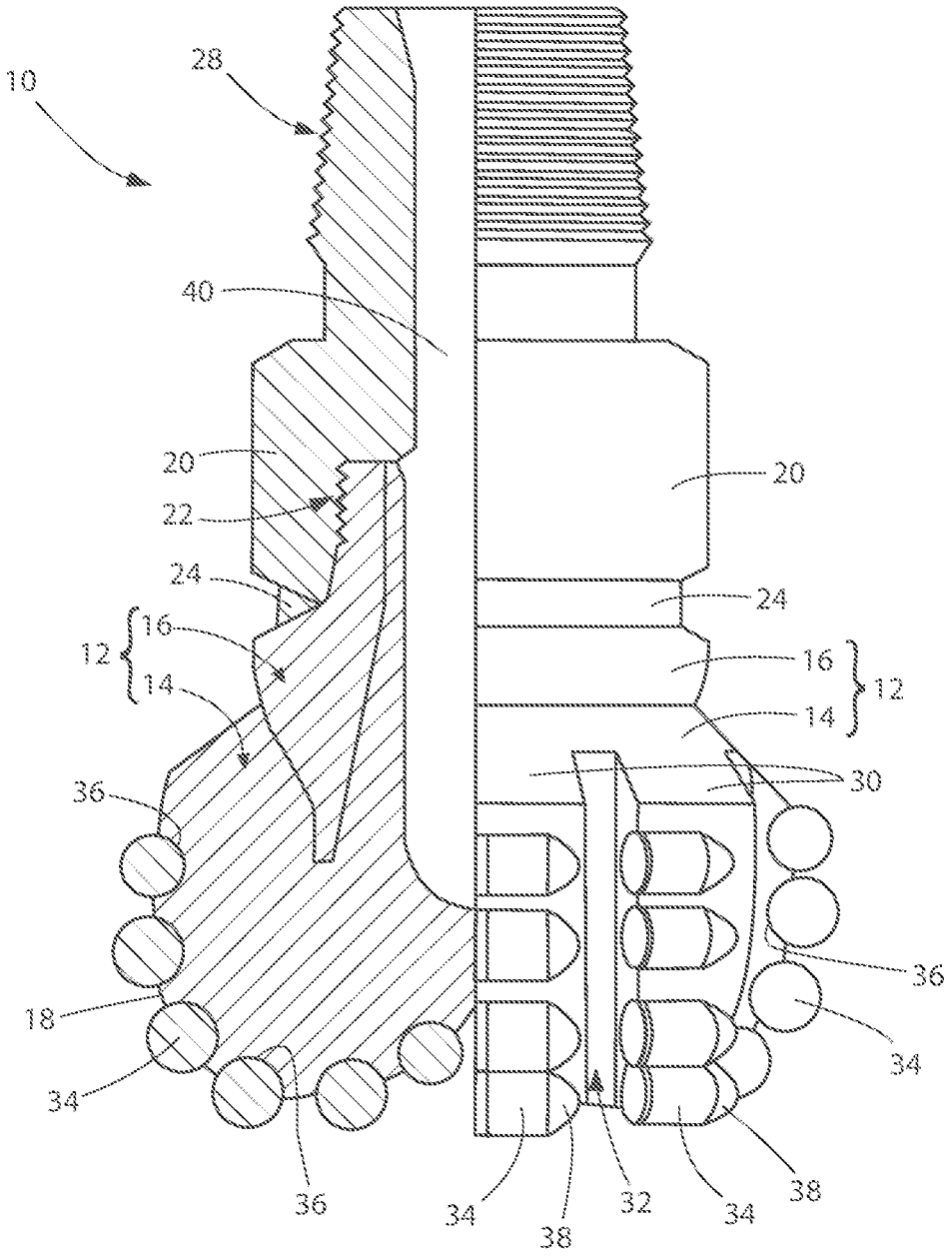
FIG. 1 is a partial cross-sectional side view of an earth-boring rotary drill bit having a bit body that includes a particle-matrix composite material.

An earth-boring rotary drill bit 10 is shown in FIG. 1 that includes a bit body 12 comprising a particle-matrix composite material. The bit body 12 is secured to a steel shank 20, which may have an American Petroleum Institute (API) or other threaded connection 28 for attaching the drill bit 10 to a drill string (not shown). The bit body 12 includes a crown 14 and a steel blank 16. The steel blank 16 is partially embedded in the crown 14. The crown 14 may include a particle-matrix composite material such as, for example, particles of tungsten carbide embedded in a copper alloy binder material. The bit body 12 is secured to the steel shank 20 by way of a threaded connection 22 and a weld 24 extending around the drill bit 10 on an exterior surface thereof along an interface between the bit body 12 and the steel shank 20.

The bit body 12 further includes wings or blades 30 that are separated by junk slots 32. Internal fluid passageways (not shown) extend between the face 18 of the bit body 12 and a longitudinal bore 40, which extends through the steel shank 20 and partially through the bit body 12. Nozzle inserts (not shown) may be provided at face 18 of the bit body 12 within the internal fluid passageways.

A plurality of cutting elements 34 are attached to the face 18 of the bit body 12. Generally, the cutting elements 34 of a fixed-cutter type drill bit have either a disk shape or a substantially cylindrical shape. A cutting surface comprising a hard, super-abrasive material, such as mutually bound particles of polycrystalline diamond, may be provided on a substantially circular end surface of each cutting element 34. Such cutting elements 34 are often referred to as "polycrystalline diamond compact" (PDC) cutting elements 34. The PDC cutting elements 34 may be provided along the blades 30 within cutting element pockets 36 formed in the face 18 of the bit body 12, and may be supported from behind by buttresses 38, which may be integrally formed with the crown 14 of the bit body 12. Typically, the cutting elements 34 are fabricated separately from the bit body 12 and secured within the cutting element pockets 36 formed in the outer surface of the bit body 12. A bonding material such as an adhesive or, more typically, a braze alloy may be used to secure the cutting elements 34 to the bit body 12.

The steel blank is generally cylindrically tubular. Alternatively, the steel blank 16 may have a fairly complex configuration and may include external protrusions corresponding to blades 30 or other features proximate an external surface of the bit body 12.

During drilling operations, the drill bit 10 is secured to the end of a drill string, which includes tubular pipe and equipment segments coupled end to end between the drill bit 10 and other drilling equipment at the surface. The drill bit 10 is positioned at the bottom of a well bore such that the cutting elements 34 are adjacent the earth formation to be drilled. Equipment such as a rotary table or top drive may be used for rotating the drill string and the drill bit 10 within the well bore. Alternatively, the steel shank 20 of the drill bit 10 may be coupled directly to the drive shaft of a down-hole motor, which then may be used to rotate the drill bit 10. As the drill bit 10 is rotated, drilling fluid is pumped to the face 18 of the bit body 12 through the longitudinal bore 40 and the internal fluid passageways. Rotation of the drill bit 10 causes the cutting elements 34 to scrape across and shear away the surface of the underlying formation. The formation cuttings mix with and are suspended within the drilling fluid and pass through the junk slots 32 and the annular space between the well bore and the drill string to the surface of the earth formation.

Bit bodies that include a particle-matrix composite material, such as the previously described bit body 12, may be fabricated in graphite molds using a so-called "infiltration" process. The cavities of the graphite molds may be machined with a multi-axis machine tool. Fine features may then added to the cavity of the graphite mold by hand-held tools. Additional clay, which may comprise inorganic particles in an organic binder material, may be applied to surfaces of the mold within the mold cavity and shaped to obtain a desired final configuration of the mold. Where necessary, preform elements or displacements (which may comprise ceramic material, graphite, or resin-coated and compacted sand) may be positioned within the mold and used to define the internal passages, cutting element pockets 36, junk slots 32, and other features of the bit body 12.

After the mold cavity has been defined and displacements positioned within the mold as necessary, a bit body may be formed within the mold cavity. The cavity of the graphite mold is filled with hard particulate carbide material (such as tungsten carbide, titanium carbide, tantalum carbide, etc.). The preformed steel blank 16 then may be positioned in the mold at an appropriate location and orientation. The steel blank 16 may be at least partially submerged in the particulate carbide material within the mold.

The mold then may be vibrated or the particles otherwise packed to decrease the amount of space between adjacent particles of the particulate carbide material. A binder material (often referred to as a "binder" material), such as a copper-based alloy, may be melted, and caused or allowed to infiltrate the particulate carbide material within the mold cavity. The mold and bit body 12 are allowed to cool to solidify the binder material. The steel blank 16 is bonded to the particle-matrix composite material that forms the crown 14 upon cooling of the bit body 12 and solidification of the binder material. Once the bit body 12 has cooled, the bit body 12 is removed from the mold and any displacements are removed from the bit body 12. Destruction of the graphite mold typically is required to remove the bit body 12. Furthermore, the displacements used to define the internal fluid passageways, nozzle cavities, cutting element pockets 36, junk slots 32, and other features of the bit body 12 may be retained within the bit body 12 after removing the bit body 12 from the mold. The displacements may then be removed completely from the bit body 12. Hand held tools such as chisels and power tools (e.g., drills and other hand held rotary tools), as well as sand or grit blasters, may be used to remove the displacements from the bit body 12.

After the bit body 12 has been removed from the mold and the displacements have been removed from the bit body 12, the PDC cutting elements 34 may be bonded to the face 18 of the bit body 12 by, for example, brazing, mechanical affixation, or adhesive affixation. The bit body 12 also may be secured to the steel shank 20. As the particle-matrix composite material used to form the crown 14 is relatively hard and not easily machined, the steel blank 16 may be used to secure the bit body 12 to the steel shank 20. Threads may be machined on an exposed surface of the steel blank 16 to provide the threaded connection 22 between the bit body 12 and the steel shank 20. The steel shank 20 may be threaded onto the bit body 12, and the weld 24 then may be provided along the interface between the bit body 12 and the steel shank 20.

It has been found, however, that the resulting rotary drill bits manufactured with bit bodies manufactured as described with regard to the bit body 12 above, may result in rotary drill bits having defects. Particularly, defects in the precise position and/or geometry of the cutting element pockets 36, which results in PDC cutting elements 34 bonded to the cutting element pockets 36 being out of position relative to the designed geometry of the drill bit 10. Such defects may result in the drill bit 10 having an actual performance that is less than the performance of a drill bit without such defects. For example, such defects may result in the drill bit 10 have a lower work rate than that of a drill bit without such defects.

Figure 2:
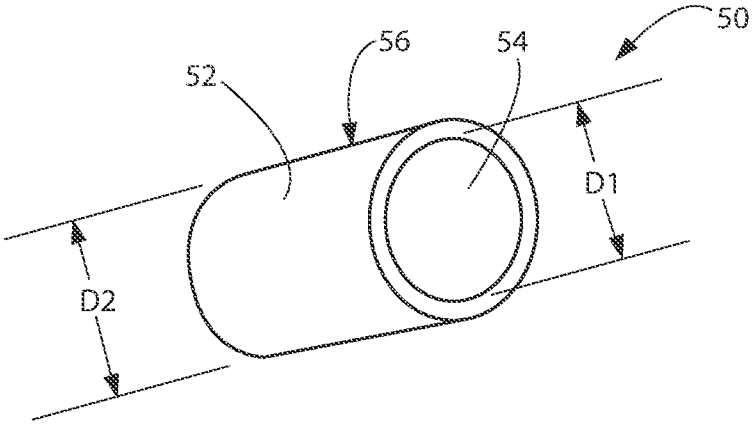
FIG. 2 is an isometric view of a displacement comprising a machineable material portion and a sacrificial material portion according to an embodiment of the present invention.
Figure 3:
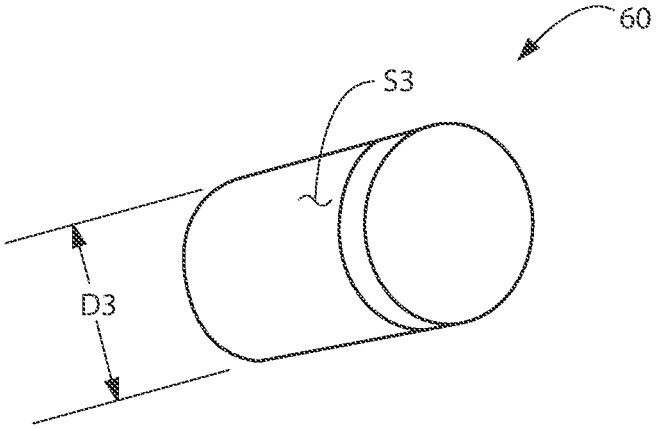
FIG. 3 is an isometric view of a cutting element.

FIG. 2 shows a displacement 50 for use in forming at least a portion of a bit body of an earth-boring rotary drill bit according to an embodiment of the present invention. The displacement 50 comprises a machineable material portion 52 configured to form an integral machineable portion of a bit body, which may be utilized to achieve very precise geometry and positioning of cutter pockets on a bit body by forming an integral machineable material portion of the bit body, as will be described in more detail further below. The displacement 50 may shaped similarly to a cutting element, such as a PDC cutting element, however, unlike traditional displacements, the geometry of the displacement 50 may be significantly larger than a cutting element that would later be positioned at the specific location on the bit body where the displacement is utilized (hereinafter a "corresponding cutting element"). For example, the displacement 50 may be shaped substantially as a cylinder and the displacement 50 may be shaped larger than a corresponding cutting element 60 (see FIG. 3). This is because at least a portion of the machineable material portion 52 of the displacement 50 will be integrated into a bit body and define at least a portion of a cutting element pocket of a bit body, as will be described in more detail further below.

The machineable material portion 52 of the displacement 50 may be comprised of a material with sufficient strength and toughness to be integrated into a bit body and to secure a corresponding cutting element 60, such as a PDC cutting element, to a bit body. The material of the machineable material portion 52 of the displacement 50 may also be selected to be machined relatively easily by conventional machining techniques, such as by a multi-axis computer numerical control (CNC) milling machine. Additionally, the material of the machineable material portion 52 of the displacement 50 may be selected to be compatible with a binder material of a bit body, so as to become successfully integrated into a bit body. For example, the machineable material portion 52 should have a sufficiently high melting temperature to withstand contact with molten binder material. In some embodiments, the machineable material portion 52 may be comprised of at least one of a metal or a metal alloy. For example, the machineable material portion 52 may comprise at least one of steel, copper, and a copper alloy (e.g., brass or bronze).

In addition to the machineable material portion 52, the displacement 50 may optionally include a sacrificial material portion 54. The sacrificial material portion may be comprised of a material that may later be relatively easily destroyed or otherwise separated from the machineable material portion 52. For example, the sacrificial material portion 54 may be comprised of at least one of graphite, a ceramic material, or resin-coated and compacted sand.

The sacrificial material portion 54 may be substantially cylindrical and the machineable material portion 52 may be configured as a sleeve having an annular portion 56 that surrounds a circumference of the sacrificial material portion 54. The annular portion 56 of the machineable material portion may have an inner diameter D1 and an outer diameter D2. The inner diameter may be smaller than an outer diameter D3 of the corresponding cutting element 60, and the outer diameter D2 may be larger than the outer diameter D3 of the corresponding cutting element.

Figure 4:
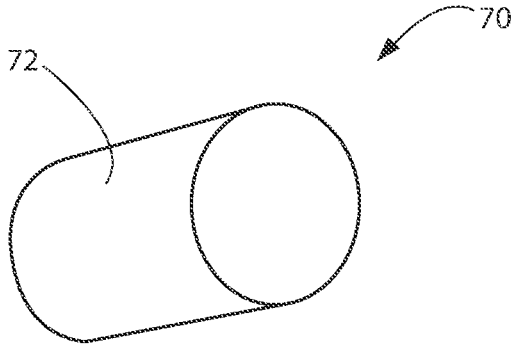
FIG. 4 is an isometric view of a displacement comprising a machineable material portion without a sacrificial portion according to embodiment of the present invention.

In additional embodiments, such as shown in FIG. 4, a displacement 70 may be comprised completely of a machineable material portion 72 and may not be comprised of any sacrificial material portion. The displacement 70 may be substantially cylindrical and may be of an overall size that is larger, at least in relative diameter, than the corresponding cutting element 60 (see FIG. 3).

Figure 5:
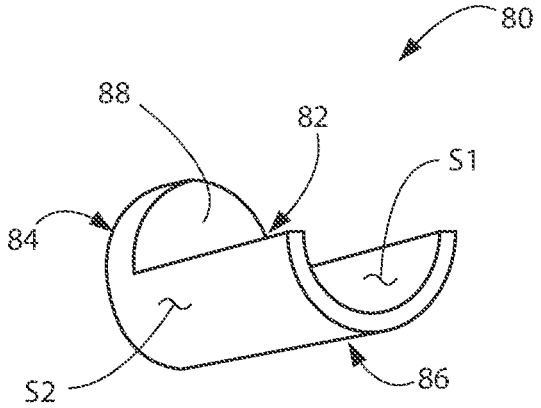
FIG. 5 is an isometric view of a displacement comprising a machineable material portion having a shape corresponding generally to the surface geometry of a cutting element pocket according to an embodiment of the present invention.

In another embodiment, such as shown in FIG. 5, a displacement 80 may not be shaped similarly to a corresponding cutting element 60. For example, the displacement 80 may have a shape corresponding generally to the surface geometry of a cutting element pocket.

The displacement 80 may include a machineable material portion 82 comprising a first portion 84 and a second portion 86. The first portion 84 may be shaped generally as a cylindrical plate, the size and shape of which may correspond generally to an end surface of the corresponding cutting element 60 (see FIG. 3), and an outer diameter D4 of the first portion 84 may be larger than the outer diameter D3 of the corresponding cutting element 60. The second portion 86 may extend from a face 88 of the first portion 84 and may be shaped generally as a segment of an annulus (i.e., a ring) defined by an outer surface S1 defined generally by a first radius of curvature and an inner surface S2 defined generally by a second radius of curvature. The first radius of curvature of the outer surface S1 of the second portion 86 of the displacement 80 may be larger than a radius of curvature of an outer surface S3 of the corresponding cutting element 60, and the second radius of curvature of the inner surface S2 of the second portion 86 of the displacement 80 may be smaller than the radius of curvature of the outer surface S3 of the corresponding cutting element 60.

Figure 6:
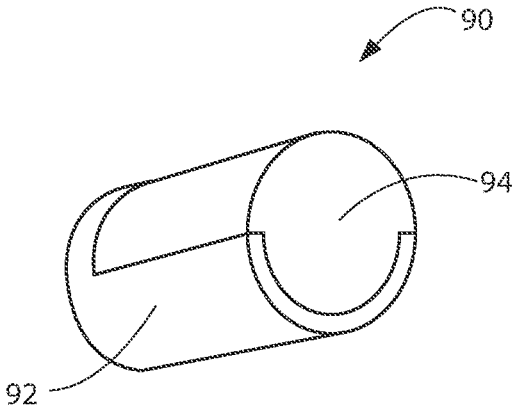
FIG. 6 is an isometric view of a displacement comprising a machineable material portion as shown in FIG. 5 and additionally including a sacrificial material portion according to an embodiment of the present invention.

In a further embodiment, such as shown in FIG. 6, a displacement 90 may include a machineable material portion 92 such as described with reference to displacement 80 (see FIG. 5) and may additionally include a sacrificial material portion 94. The sacrificial material portion 94 may be shaped to correspond to the machineable material portion 92 such that the overall shape of the displacement 90 is generally cylindrical. The displacement 90 may be of an overall size that is larger, at least in relative diameter, than the corresponding cutting element 60 (see FIG. 3).

Figure 7:
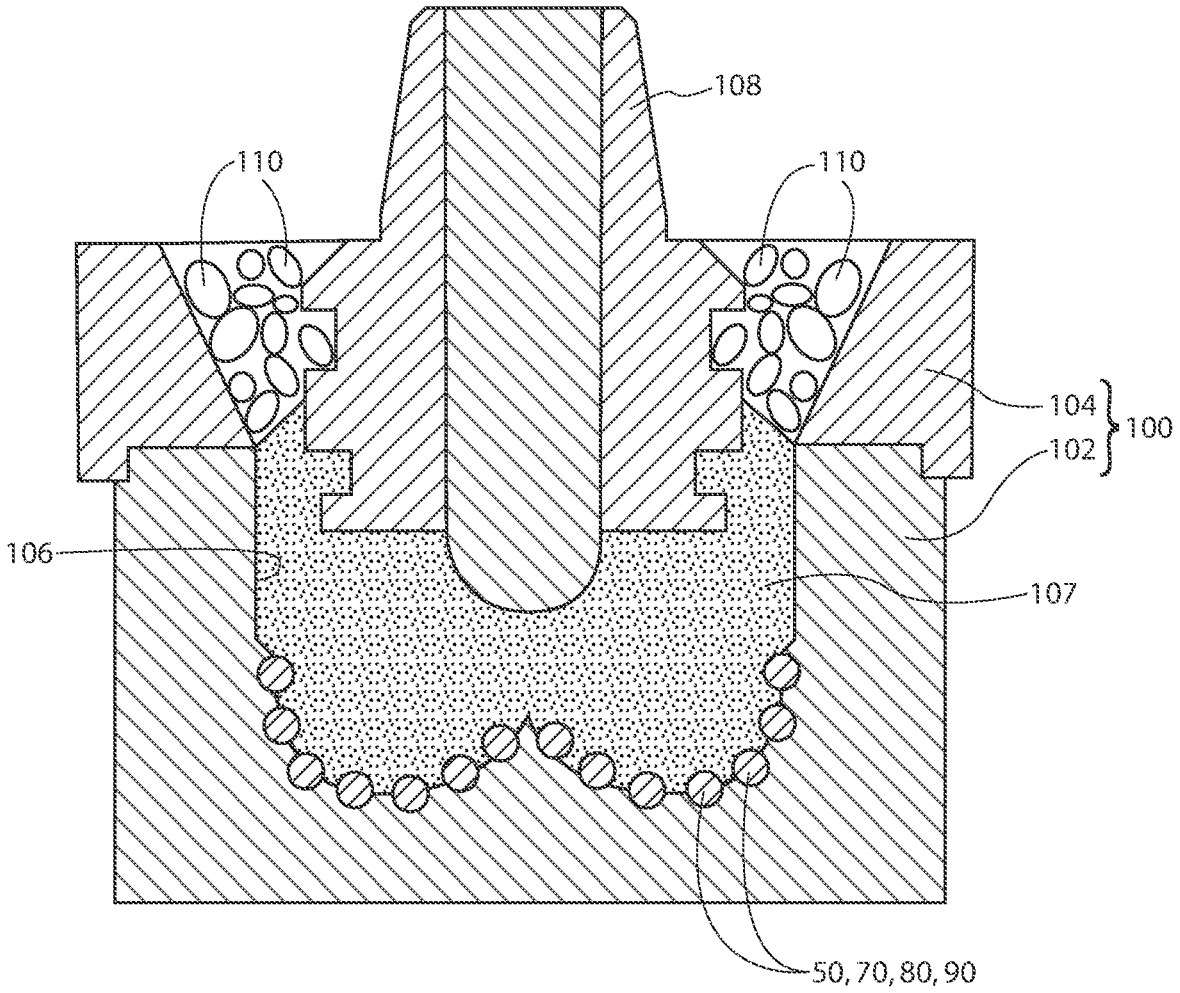
FIG. 7 is a cross-sectional view illustrating a method of forming a bit body of an earth-boring rotary drill bit utilizing displacements such as shown in FIGS. 2, 4, 5, and 6 according to an embodiment of the present invention.

Referring to FIG. 7, displacements that embody teachings of the present invention (such as, for example, the displacements 50, 70, 80, 90) may be used in infiltration methods for forming bit bodies and earth-boring rotary drill bits according to further embodiments of the present invention. For example, a mold 100 may be provided, which may include a lower portion 102 and an upper portion 104. A plurality of displacement members that embody teachings of the present invention, such as, for example, the displacements 50, 70, 80, 90, may be provided at selected locations in a cavity 106 within the mold 100. For example, displacements 50, 70, 80, 90 may be provided at locations corresponding to locations wherein cutting element pockets are to be formed.

The cavity 106 within the mold 100 may be filled with hard particles 107 comprising a hard material (such as, for example, tungsten carbide, titanium carbide, tantalum carbide, etc.). A preformed steel blank 108 comprising a metal or metal alloy such as steel then may be positioned in the mold 100 at an appropriate location and orientation. The steel blank 108 may be at least partially submerged in the hard particles 107 within the mold 100.

The mold 100 may be vibrated or the hard particles 107 otherwise packed to decrease the amount of space between adjacent hard particles 107. A binder material may be melted, and caused or allowed to infiltrate the hard particles 107 within the cavity 106 of the mold 100. By way of example, the binder material may comprise copper or copper-based alloy.

As a non-limiting example, particles 110 comprising a binder material may be providing over the hard particles 107. The mold 100, as well as the hard particles 107 and the particles 110 of binder material, may be heated to a temperature above the melting point of the binder material to cause the particles 110 of binder material to melt. The molten binder material may be caused or allowed to infiltrate the hard particles 107 within the cavity 106 of the mold 100.

The mold 100 then may be allowed or caused to cool to solidify the binder material. The machineable material portion 52, 72, 82, 92 of the displacements 50, 70, 80, 90 and the sacrificial material portions 54, 94 of the displacements 50, 90 (if any) may be bonded to the particle-matrix composite material and become an integral part of a resulting bit body 200 (see FIG. 8) upon solidification of the binder material. Additionally, the steel blank 108 may be bonded to the particle-matrix composite material that forms the resulting bit body upon solidification of the binder material. Once the bit body 200 has cooled, the bit body may be removed from the mold 100, and at least a portion of the sacrificial material portions 54, 94 (if any) of the displacements 50, 70, 80, 90 may be removed from the bit body 200. For example, all of the sacrificial material portions 54, 94 (if any) of the displacements may be completely removed from the bit body, or only a portion of each sacrificial material portion 54, 94 may be removed and a relatively thin layer or film of the sacrificial material portion may remain on the bit body 200.

Accordingly, a method of manufacturing a bit body 200 (see FIG. 8) for use in an earth-boring rotary drill bit according to an embodiment of the present invention may comprise the following steps. A plurality of displacements 50, 70, 80, 90 may be provided, wherein each displacement 50, 70, 80, 90 of the plurality of displacements 50, 70, 80, 90 comprises a machineable material portion 52, 72, 82, 92. The plurality of displacements 50, 70, 80, 90 may be positioned into a mold 100. The hard particles 107 may then be positioned into the mold 100. The binder material may then may be melted and the hard particles 107 may be infiltrated with the molten binder material.

Figure 8:
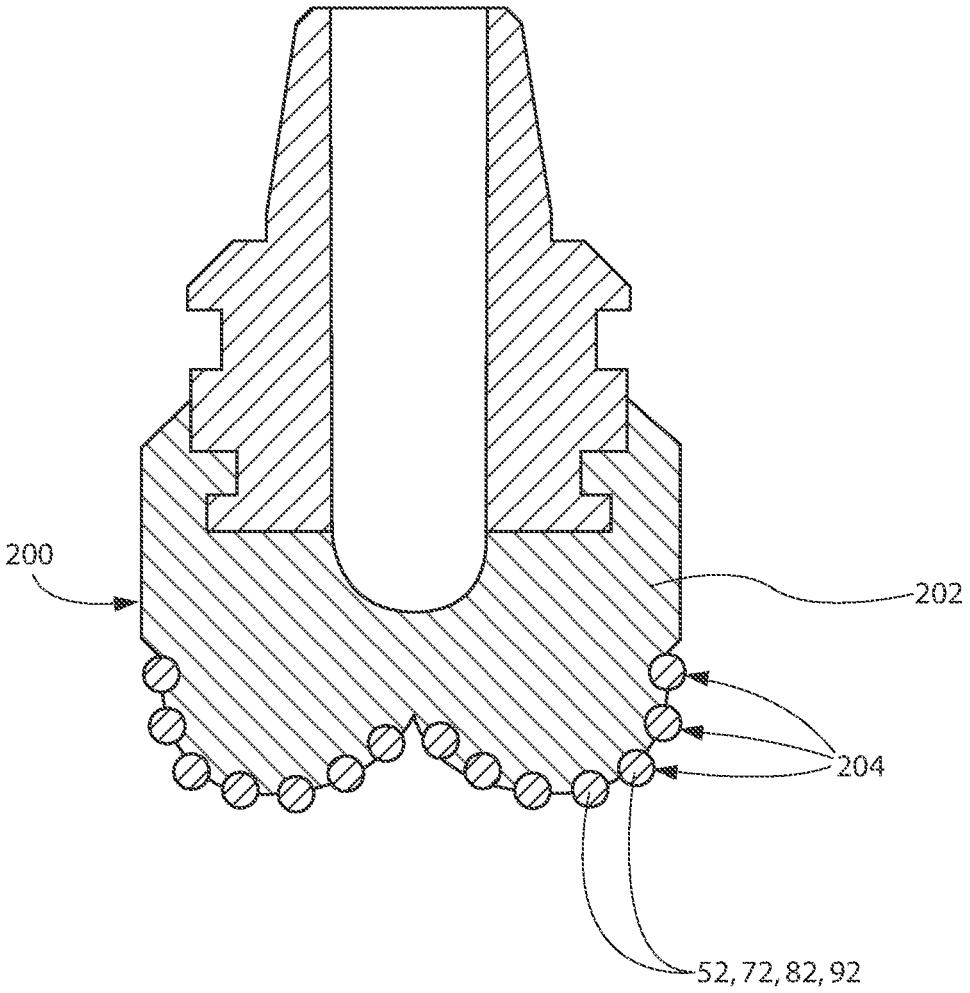
FIG. 8 is a cross-sectional view of a bit body resulting from the method illustrated in FIG. 7 according to an embodiment of the present invention.

As shown in FIG. 8, the binder material may then be cooled to form the bit body 200 such that the binder material and the hard particles combine to form a main body 202 of the bit body 200 comprising a particle-matrix composite material and the binder material. The binder material may also be cooled such that the machineable material portion 52, 72, 82, 92 of each of the plurality of displacements 50, 70, 80, 90 and the binder material form a bond therebetween resulting in the formation of a plurality of integral machineable material portions 204 in the bit body 200.

In some embodiments, the step of providing displacements 50, 70, 80, 90 may further comprise providing at least one displacement 50, 70, 80, 90 of the plurality of displacements 50, 70, 80, 90 that includes a sacrificial material portion 54, 94. Accordingly, the method may also further comprise removing each sacrificial material portion 54, 94 from the bit body 200 after cooling the binder material.

As previously discussed with regard to FIG. 8, the cooled bit body 200 may comprise the main body 202 comprised of a particle-matrix composite material and a plurality of integral machineable material portions 204 according to an embodiment of the present invention. The particle-matrix composite material of the main body 202 may comprise the hard particles 107 and the binder material. The integral machineable material portions 204 of the bit body 200 are derived from the machineable material portions 52, 72, 82, 92 of the displacements 50, 70, 80, 90. Accordingly, the integral machineable material portions 204 may be substantially free of the hard particles 107. The positions of the integral machineable material portions 204 may correspond to the intended positions of cutting element pockets, where corresponding cutting elements will be coupled to the bit body 200. Accordingly, the bit body 200 may comprise a particle-matrix composite material main body 202 and include integral machineable material portions 204 derived from the displacements 50, 70, 80, 90. The integral machineable material portions 204 of the bit body 200 may be relatively easily machined as the integral machineable material portions 204 of the bit body 200 will be comprised of a machineable material, such as a metal or a metal alloy, and will be substantially free of the hard particles 107.

Figure 9:
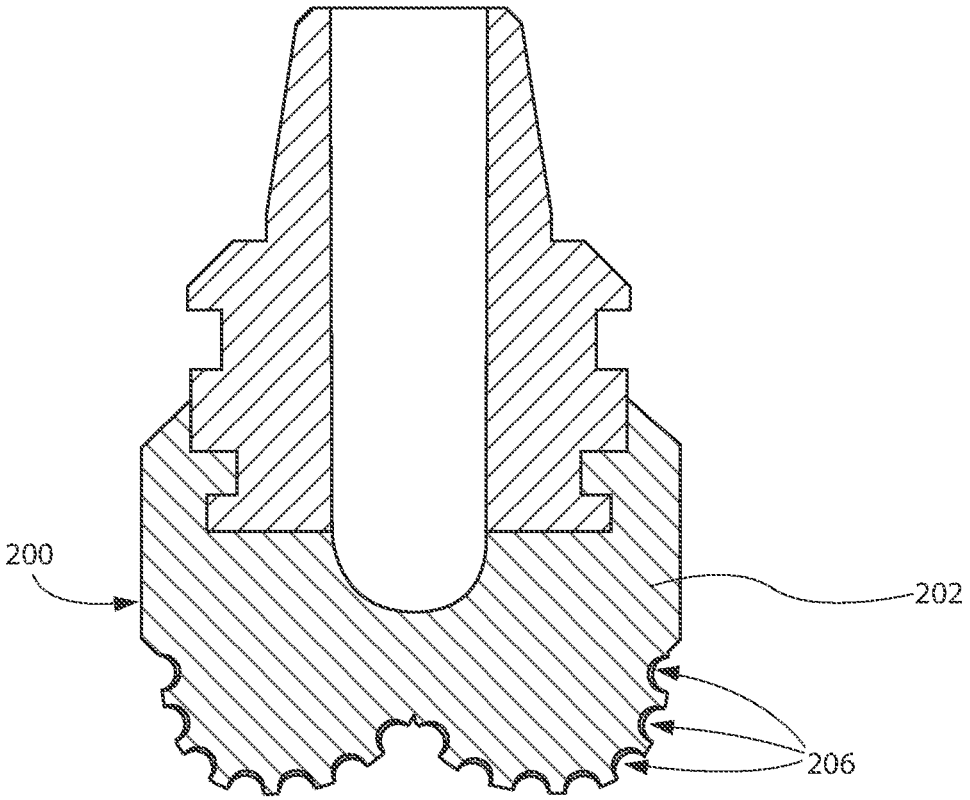
FIG. 9 is a cross-sectional view of the bit body of FIG. 8 showing cutting element pockets machined therein according to an embodiment of the present invention.

The method of manufacturing the bit body 200 may further comprise machining each of the integral machineable material portions 204 of the bit body 200 to define a plurality of cutting element pockets 206 (see FIG. 9). For example, the bit body 200 may be positioned within a multi-axis CNC milling machine (not shown), which may precisely machine the size and shape of the cutting element pockets 206 relative to the size and shape of the corresponding cutting elements 208 (see FIG. 10), and relative to the spatial positions of each of the other cutting element pockets 206, by machining the integral machineable material portions 204. Accordingly, the bit body 200 may comprise a plurality of cutting element pockets 206 wherein at least a portion of each of the plurality of cutting element pockets 206 is defined by an integral machineable material portion 204 of the plurality of integral machineable material portions 204.

As shown in FIG. 9, the precision machining of the integral machineable material portions 204 to form the cutting element pockets 206 may result in a bit body 200 with very precise cutting element pocket geometry and positioning, and thus may also result in an earth-boring rotary drill bit 210 (see FIG. 10) having very precise cutting element 208 positioning without the need of excessively time consuming and expensive molding processes.

Figure 10:
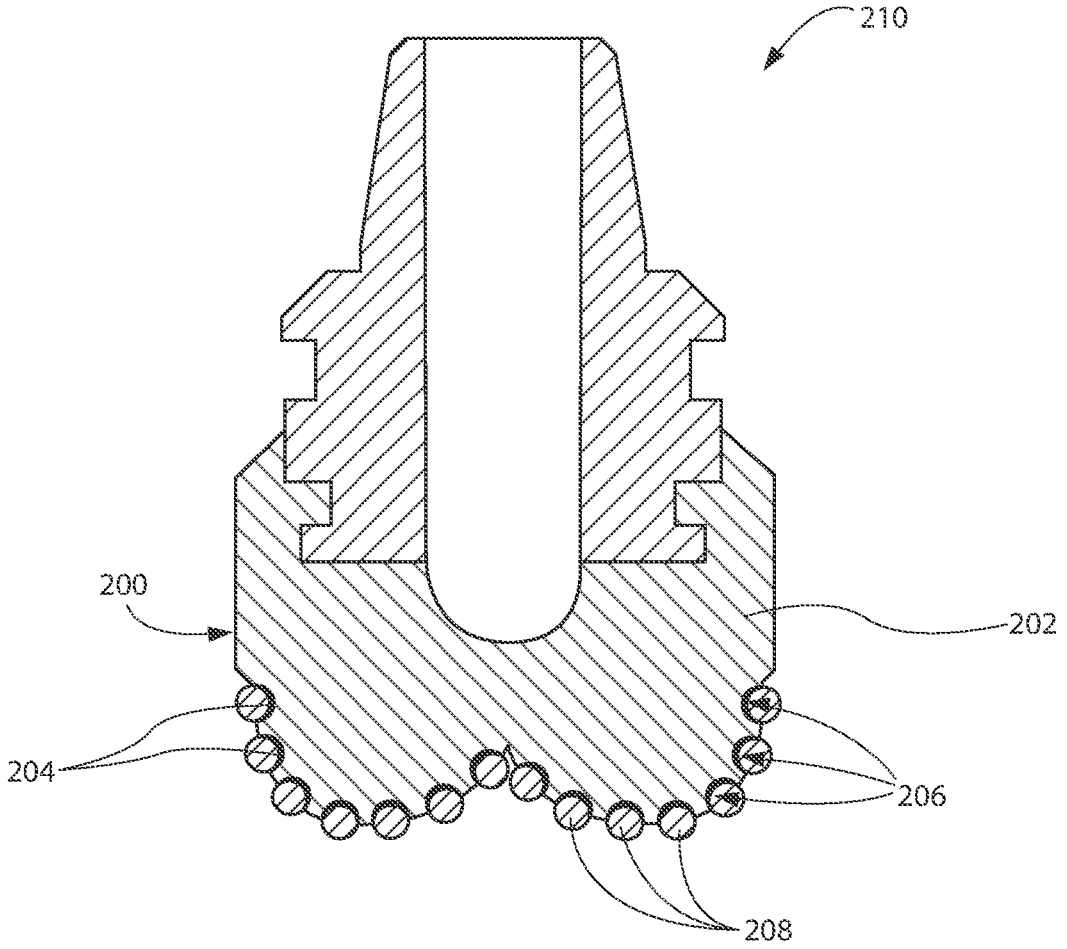
FIG. 10 is a cross-sectional view of an earth-boring rotary drill bit including cutting elements and a bit body as shown in FIG. 9 according to an embodiment of the present invention.

As shown in FIG. 10, the earth-boring rotary drill bit 210 may comprise the bit body 200 as described with reference to FIGS. 7-9 according to an embodiment of the present invention. The earth-boring rotary drill bit 210 may be manufactured by manufacturing a bit body 200, as described herein with reference to FIGS. 7-9, and incorporating the bit body 200 in the earth-boring rotary drill bit 210. A cutting element 208, such as a PDC cutting element, may be positioned within each of the plurality of cutting element pockets 206. Each cutting element 208 may then be bonded to a corresponding cutting element pocket 206, by, for example, brazing, mechanical affixation, or adhesive affixation to form the earth-boring rotary drill bit 210. Optionally, each cutting element 208 may be measured and rank ordered prior to being bonded to a corresponding cutting element pocket 206. Accordingly, each cutting element 208 may be positioned in a similarly sized cutting element pocket 206, or each cutting element pocket 206 may be machined specifically to correspond to a measurement of a specific cutting element 208. Additionally, an API or other threaded connection may be coupled to the steel blank 108 to facilitate the connection of the earth-boring rotary drill bit 210 to a drill string.

While teachings of the present invention are described herein in relation to displacement members for use in forming earth-boring rotary drill bits that include fixed cutters, displacement members that embody teachings of the present invention may be used to form other subterranean tools including, for example, core bits, eccentric bits, bicenter bits, reamers, mills, drag bits, roller cone bits, and other such structures known in the art may be formed by methods that embody teachings of the present invention. Furthermore, displacement members that embody teachings of the present invention may be used to form any article of manufacture in which it is necessary or desired to use a displacement member to define a surface of the article of manufacture as the article of manufacture is formed at least partially around the displacement member.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. A displacement for use in manufacturing a bit body of an earth-boring rotary drill bit, the displacement comprising a machineable material portion configured to form an integrated machineable portion of a bit body of an earth-boring rotary drill bit, the machineable material portion sized and shaped to be machined to form a cutting element pocket, wherein the machineable material portion is at least partially annular and is made of metal or metal alloy.

2. The displacement of claim 1, further comprising a sacrificial portion.

3. The displacement of claim 2, wherein the sacrificial portion is comprised of at least one of graphite, a ceramic material, or resin-coated and compacted sand.

4. The displacement of claim 1, wherein the machineable material portion comprises at least one of steel, copper, and a copper alloy.

5. The displacement of claim 1, wherein the displacement is shaped substantially as a cylinder.

6. The displacement of claim 5, wherein the displacement is shaped larger than a corresponding cutting element.

7. The displacement of claim 1, wherein the machineable material portion includes the at least partially annular portion having an inner diameter and an outer diameter, wherein the inner diameter is smaller than a diameter of a corresponding cutting element and the outer diameter is larger than the diameter of the corresponding cutting element.

8. The displacement of claim 1, wherein the machineable material portion comprises:

a first portion shaped generally as a cylindrical plate; and a second portion extending from a face of the first portion, the second portion shaped generally as a segment of an annulus.

9. The displacement of claim 8, wherein:

the first portion of the machineable material portion has an outer diameter that is larger than an outer diameter of a corresponding cutting element; and the second portion of the machineable material portion has an outer surface defined generally by a first radius of curvature and an inner surface defined generally by a second radius of curvature, wherein the first radius of curvature is larger than a radius of curvature of the corresponding cutting element, and the second radius of curvature is smaller than the radius of curvature of the corresponding cutting element.

10. A bit body for use in an earth-boring rotary drill bit comprising:

a main body comprised of a particle-matrix composite material, the particle-matrix composite material comprising hard particles and a binder material;

a plurality of integral machineable material portions, the plurality of integral machineable material portions being substantially free of the hard particles and each of the plurality of integral machineable material portions comprising a machined surface defining a cutting element pocket; and wherein at least one of the plurality of integral machineable material portions is at least partially annular and is made of metal or metal alloy.

11. An earth-boring rotary drill bit comprising:

a bit body comprising:

a main body comprised of a particle-matrix composite material, the particle-matrix composite material comprising hard particles and a binder material;

a plurality of integral machineable material portions, the plurality of integral machineable material portions being substantially free of the hard particles and each of the plurality of integral machineable material portions comprising a machined surface defining a cutting element pocket; and wherein at least one of the plurality of integral machineable material portions is at least partially annular and is made of metal or metal alloy.

12. The earth-boring rotary drill bit of claim 11, further comprising a cutting element positioned within each cutting element pocket.

13. A method of manufacturing a bit body for use in an earth-boring rotary drill bit, the method comprising:

providing a displacement for use in manufacturing the bit body of the earth-boring rotary drill bit, the displacement comprising a machineable material portion configured to form an integrated machineable material portion of the bit body, the machineable material portion sized and shaped to be machined to form a cutting element pocket, wherein the machineable material portion is at least partially annular and is made of metal or metal alloy;

positioning the displacement into a mold;

positioning hard particles into the mold;

melting a binder material;

infiltrating the hard particles with the binder material; and cooling the binder material to form a bit body such that the binder material and the hard particles combine to form a main body of the bit body comprising a particle-matrix composite material and the binder material and the machineable material portion of the displacement form a bond therebetween to form an integral machineable material portion of the bit body.

14. The method of claim 13, further comprising machining the integral machineable material portion of the bit body to define the cutting element pocket.

15. The method of claim 14, further comprising:

providing at least one displacement that includes a sacrificial material portion; and removing at least a portion of each sacrificial material portion from the bit body after cooling the binder material.

16. A method of manufacturing an earth-boring rotary drill bit, the method comprising:

providing a displacement for use in manufacturing a bit body of the earth-boring rotary drill bit, the displacement comprising a machineable material portion configured to form an integrated machineable material portion of the bit body, the machineable material portion sized and shaped to be machined to form a cutting element pocket, wherein the machineable material portion is at least partially annular and is made of metal or metal alloy;

positioning the displacement into a mold;

positioning a plurality of hard particles into the mold;

melting a binder material;

infiltrating the plurality of hard particles with the binder material;

cooling the binder material to form the bit body such that the binder material and the hard particles combine to form a main body of the bit body comprising a particle-matrix composition and the binder material and the machineable material portion of the displacement form a bond therebetween to form an integral machineable material portion of the bit body;

machining the integral machineable material portion of the bit body to define the cutting element pocket; and positioning a cutting element into the cutting element pocket.

17. The method of claim 16, further comprising:

providing at least one displacement that includes a sacrificial material portion; and removing at least a portion of the sacrificial material portions from the bit body after cooling the binder material.

* * * * *